US010154550B2

(12) United States Patent
Lee et al.

(10) Patent No.: US 10,154,550 B2
(45) Date of Patent: Dec. 11, 2018

(54) BACKLIGHT UNIT, DISPLAY APPARATUS HAVING THE SAME AND OPERATING METHOD OF BACKLIGHT UNIT

(71) Applicant: Samsung Display Co., Ltd., Yongin-si, Gyeonggi-do (KR)

(72) Inventors: Dae-Sik Lee, Asan-si (KR); Won-Hyoung Kang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 332 days.

(21) Appl. No.: 14/849,462

(22) Filed: Sep. 9, 2015

(65) Prior Publication Data

US 2016/0267833 A1 Sep. 15, 2016

(30) Foreign Application Priority Data

Mar. 11, 2015 (KR) ..... 10-2015-0033986

(51) Int. Cl.
*H05B 33/08* (2006.01)
*G09G 3/34* (2006.01)

(52) U.S. Cl.
CPC ..... *H05B 33/0803* (2013.01); *G09G 3/3406* (2013.01); *H05B 33/086* (2013.01); *G09G 2330/028* (2013.01); *G09G 2330/12* (2013.01)

(58) Field of Classification Search
CPC ..... H05B 33/0815
See application file for complete search history.

(56) References Cited

U.S. PATENT DOCUMENTS

2012/0104967 A1* 5/2012 Lee ..... H05B 33/0815 315/291
2013/0113844 A1* 5/2013 Kim ..... H05B 33/0887 345/690

(Continued)

FOREIGN PATENT DOCUMENTS

KR 10-2011-0015264 A 2/2011
KR 10-2011-0034571 A 4/2011

(Continued)

OTHER PUBLICATIONS

English Abstract for KR20110137440 (A) dated Sep. 23, 2011 Which Corresponds to KR10-1100105 B1 Listed Above, 1 pg.

*Primary Examiner* — Dennis Joseph
*Assistant Examiner* — Maheen Javed
(74) *Attorney, Agent, or Firm* — Lewis Roca Rothgerber Christie LLP

(57) ABSTRACT

A backlight unit includes: a power converter to generate a light-source power voltage according to a voltage control signal; an LED string connected to the light-source power voltage; a short-circuit detector to receive the light-source power voltage and to enable a short-circuit signal; and a light source controller to generate the voltage control signal to interrupt generation of the light-source power voltage when the short-circuit signal is enabled. The short-circuit detector includes: a voltage divider to divide the light-source power voltage to output a detection voltage; and a comparing circuit to generate a reference voltage corresponding to a voltage level of the detection voltage, to compare the reference voltage with the detection voltage, and to enable the short-circuit signal in accordance with a result of the comparison.

11 Claims, 6 Drawing Sheets

(56) References Cited

U.S. PATENT DOCUMENTS

| | | | | |
|---|---|---|---|---|
| 2013/0114167 | A1* | 5/2013 | Lin | H05B 33/089 361/42 |
| 2013/0313985 | A1* | 11/2013 | Choi | H05B 33/0815 315/192 |
| 2014/0203718 | A1 | 7/2014 | Yoon et al. | |
| 2015/0237695 | A1* | 8/2015 | Jelaca | H05B 33/0815 315/291 |
| 2015/0264771 | A1* | 9/2015 | Lin | H05B 33/0851 315/307 |

FOREIGN PATENT DOCUMENTS

| | | | |
|---|---|---|---|
| KR | 10-1100105 | B1 | 12/2011 |
| KR | 10-2012-0070421 | A | 6/2012 |
| KR | 10-2013-0049126 | A | 5/2013 |
| KR | 10-2013-0056085 | A | 5/2013 |
| KR | 10-2013-0130526 | A | 12/2013 |
| KR | 10-2014-0083565 | A | 7/2014 |

* cited by examiner

BACKLIGHT UNIT, DISPLAY APPARATUS HAVING THE SAME AND OPERATING METHOD OF BACKLIGHT UNIT

CROSS-REFERENCE TO RELATED APPLICATION

This U.S. non-provisional patent application claims priority to and the benefit of Korean Patent Application No. 10-2015-0033986, filed on Mar. 11, 2015, the content of which is hereby incorporated by reference in its entirety.

BACKGROUND

1. Field

One or more aspects of embodiments of the inventive concepts described herein relate to a backlight unit and a display apparatus having the same.

2. Description of the Related Art

A display apparatus as one of user interfaces is becoming indispensable for an electronic device. Many electronic devices are employing flat-panel display apparatuses for lightweight, simplification, and miniaturization.

Liquid Crystal Displays (LCDs), which may be commonly utilized, are examples of light receiving apparatuses. Therefore, an LCD may utilize a Back Light Unit (BLU) including a backlight lamp that is an additional light source for controlling a quantity of light which may be incident from the external.

In recent years, Light Emitting Diodes (LEDs) having lower power consumption, eco-friendly usage, and slimness are widely employed in display apparatuses. However, it could be difficult to design an LED having uniformity of luminance and colors over the whole area of a display apparatus, thus requiring high technology for transient control of LED current to mix colors.

Furthermore, a backlight unit may have an LED string, which includes a plurality of LEDs coupled in series, to provide luminance that is utilized in a display apparatus. If at least one of the LEDs is short-circuited, an overcurrent may flow causing damage to the backlight unit.

The above information disclosed in this Background section is only for enhancement of understanding of the background of the inventive concepts and therefore it may contain information that does not form prior art.

SUMMARY

One or more aspects of the present disclosure provides a backlight unit capable of detecting a short circuit of an LED string.

One or more aspects of the present disclosure provides a display apparatus including a backlight unit capable of detecting a short circuit of an LED string.

One or more aspects of the present disclosure provides an operation method for a backlight unit capable of detecting a short circuit of an LED string.

According to one embodiment, a backlight unit may include: a power converter configured to generate a light-source power voltage according to a voltage control signal; an LED string connected to the light-source power voltage; a short-circuit detector configured to receive the light-source power voltage and to enable a short-circuit signal; and a light source controller configured to generate the voltage control signal to interrupt generation of the light-source power voltage when the short-circuit signal is enabled. The short-circuit detector may include: a voltage divider configured to divide the light-source power voltage to output a detection voltage; and a comparing circuit configured to generate a reference voltage corresponding to a voltage level of the detection voltage, to compare the reference voltage with the detection voltage, and to enable the short-circuit signal in accordance with a result of the comparison.

In one embodiment, the comparing circuit may include: a first comparator configured to compare the voltage level of the detection voltage with that of a first voltage, and to output a first comparison signal; a second comparator configured to compare the voltage level of the detection voltage with that of a second voltage, and to output a second comparison signal; an adding circuit configured to output the reference voltage corresponding to the first comparison signal and the second comparison signal; and a third comparator configured to compare a voltage level of the reference voltage with that of the detection voltage, and to enable the short-circuit signal in accordance with the result of the comparison.

In one embodiment, the adding circuit may be configured to add the first comparison signal, the second comparison signal, and a bias voltage to output the reference voltage.

In one embodiment, a voltage level of the second voltage may be higher than that of the first voltage.

In one embodiment, the comparing circuit may be configured to: output the reference voltage with a first reference voltage level when the detection voltage is lower than a first voltage level; output the reference voltage with a second reference voltage level when the detection voltage is higher than the first voltage level and lower than a second voltage level; and output the reference voltage with a third reference voltage level when the detection voltage is higher than the second voltage level. The second voltage level may be higher than the first voltage level.

In one embodiment, the comparing circuit may include: a first comparator configured to compare the detection voltage with a pulse voltage to output a comparison signal; a counter configured to output a count signal in synchronization with a clock signal when the comparison signal is at a first signal level; a reference voltage selector configured to output the reference voltage from one of a plurality of voltages having different voltage levels from each other in response to the count signal; and a second comparator configured to compare a voltage level of the reference voltage with that of the detection voltage, and to enable the short-circuit signal in accordance with the result of the comparison.

In one embodiment, the pulse voltage may include a triangular pulse voltage.

In one embodiment, the first comparator may be configured to output the comparison signal with the first level when the voltage level of the detection voltage is lower than that of the pulse voltage.

In one embodiment, the reference voltage selector may be configured to: output the reference voltage with a first level when the count signal is lower than a first value; output the reference voltage with a second level when the count level is lower than the first value and lower than a second value; and output the reference voltage with a third level when the count signal is higher than the second value. The second value may be higher than the first value.

In one embodiment, one end of the LED string may be connected to the light-source power voltage and another end of the LED string may be connected to the light source controller.

In one embodiment, the voltage divider may include: a first resistor connected between the light-source voltage and a first node; and a second resistor connected between the first node and a ground voltage. The voltage divider may be configured to output a voltage at the first node as the detection voltage.

According to another embodiment, a display apparatus may include: a display panel including a plurality of pixels; a drive circuit configured to control the display panel to display an image; and a backlight configured to supply light to the display panel. The backlight may include: a power converter configured to generate a light-source power voltage according to a voltage control signal; an LED string connected to the light-source power voltage; a short-circuit detector configured to receive the light-source power voltage and to enable a short-circuit signal; and a light source controller configured to generate the voltage control signal to interrupt generation of the light-source power voltage when the short-circuit signal is enabled. The short-circuit detector may include: a voltage divider configured to divide the light-source power voltage to output a detection voltage; and a comparing circuit configured to generate a reference voltage corresponding to a voltage level of the detection voltage, to compare the reference voltage with the detection voltage, and to enable the short-circuit signal in accordance with a result of the comparison.

In one embodiment, the comparing circuit may include: a first comparator configured to compare the voltage level of the detection voltage with that of a first voltage to output a first comparison signal; a second comparator configured to compare the voltage level of the detection voltage with that of a second voltage to output a second comparison signal; an adding circuit configured to output the reference voltage corresponding to the first comparison signal and the second comparison signal; and a third comparator configured to compare a voltage level of the reference voltage with that of the detection voltage, and to enable the short-circuit signal in accordance with the result of the comparison.

In one embodiment, the adding circuit may be configured to add the first comparison signal, the second comparison signal, and a bias voltage to output the reference voltage.

In one embodiment, a voltage level of the second voltage may be higher than that of the first voltage.

In one embodiment, the comparing circuit may include: a first comparator configured to compare the detection voltage with a pulse voltage to output a comparison signal; a counter configured to output a count signal in synchronization with a clock signal when the comparison signal is at a first signal level; a reference voltage selector to output the reference voltage from one of a plurality of voltages having different voltage levels from each other in response to the count signal; and a second comparator configured to compare a voltage level of the reference voltage with that of the detection voltage, and to enable the short-circuit signal in accordance with the result of the comparison.

According to another embodiment, an operation method of a backlight unit may include: providing a light-source power voltage; detecting a voltage level of the light-source power voltage; outputting a reference voltage corresponding to a voltage level of a detection voltage; comparing the reference voltage with the detection voltage and enabling a short-circuit signal in accordance with a result of the comparison; and interrupting generation of the light-source power voltage when the short-circuit signal is enabled.

In one embodiment, the outputting of the reference voltage may include: outputting the reference voltage with a first level when the detection voltage is lower than a first voltage level; outputting the reference voltage with a second level when the detection voltage is higher than the first voltage level and lower than a second voltage level; and outputting the reference voltage with a third level when the detection voltage is higher than the second voltage level. The second voltage level may be higher than the first voltage level.

In one embodiment, the outputting of the reference voltage may include: comparing the detection voltage with a pulse signal to output a comparison signal; outputting a count signal in synchronization with a clock signal when the comparison signal is at a first signal level; and outputting the reference voltage from one of a plurality of voltages having different voltage levels from each other in response to the count signal.

In one embodiment, the outputting of the one of the plurality of voltages may include: outputting the reference voltage with a first level when the count signal is lower than a first value; outputting the reference voltage with a second level when the count signal is higher than the first value and lower than a second value; and outputting the reference voltage with a third level when the count signal is higher than the second value. The second value may be higher than the first value.

According to one or more embodiments of the inventive concept, it may be possible to detect a short circuit of an LED string by comparing a reference voltage with a light-source power voltage which is supplied to the LED string. Since a voltage level of the reference voltage that is generated from a power converter may be modified, it may be possible to correctly detect a short circuit of the LED string.

BRIEF DESCRIPTION OF THE DRAWINGS

Aspects of embodiments of the inventive concepts will become more apparent in view of the attached drawings and accompanying detailed description.

DETAILED DESCRIPTION

Figure 1:
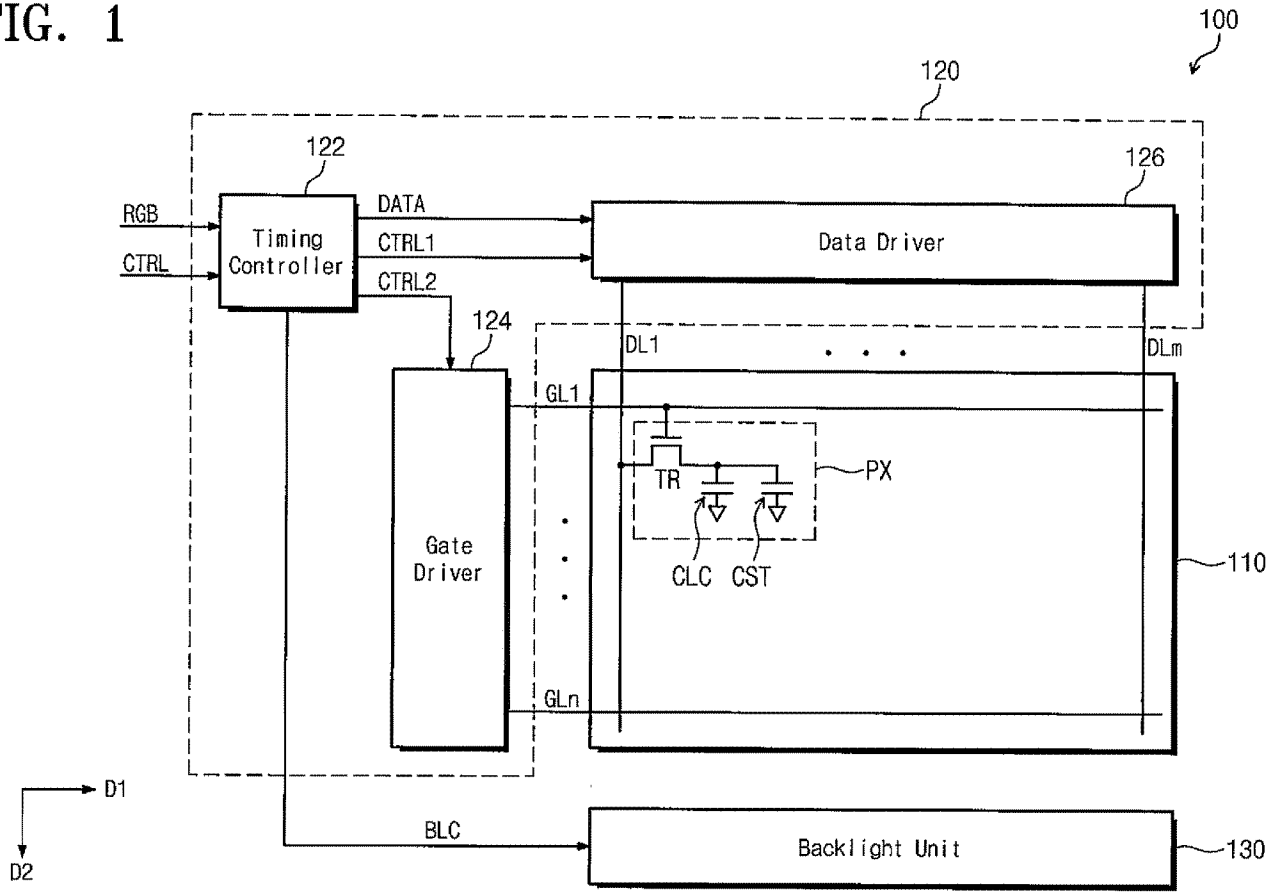
FIG. 1 is a block diagram illustrating a display apparatus according to an embodiment of the inventive concept.

Hereinafter, example embodiments will be described in more detail with reference to the accompanying drawings, in which like reference numbers refer to like elements throughout. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof may not be repeated.

FIG. 1 is a block diagram illustrating a display apparatus according to an embodiment of the inventive concept.

Referring to FIG. 1, the display apparatus 100 may include a display panel 110, a drive circuit 120, and a backlight unit (or backlight) 130.

The display panel 110 may display an image. In one embodiment, the display panel 110 includes an LCD panel. However, the present inventive concept is not limited thereto, and the display panel 110 may be another kind of display panel that utilizes the backlight unit 130.

The display panel 110 may include a plurality of gate lines GL1~GLn extending along a first direction D1, and a plurality of data lines DL1~DLm crossing the gate lines GL1~GLn. A plurality of pixels PX may be arranged at areas where the plurality of data lines DL1~DLm crosses the plurality of gate lines GL1~GLn. The plurality of data lines DL1~DLm may be insulated from the plurality of gate lines GL1~GLn. Each of the pixels PX may include a thin film transistor TR, a liquid crystal capacitor CLC, and a storage capacitor CST.

Each of the plurality of pixels PX may be formed with the same or substantially the same structure. Thus, in the description below, one pixel will be described as a representative, and therefore, duplicated descriptions for other respective pixels may not be described. The thin film transistor TR of the pixel PX may include a gate electrode connected to the first gate line GL1 of the plurality of gate lines GL1~GLn, a source electrode connected to the first data line DL1 of the plurality of data lines DL1~DLm, and a drain electrode connected to a liquid crystal capacitor CLC and a storage capacitor CST. An end of the liquid crystal capacitor CLC and an end of the storage capacitor CST may be connected to the drain electrode in parallel. Another end of the liquid crystal capacitor CLC and another end of the storage capacitor CST may be connected to a common voltage.

The drive circuit 120 may include a timing controller 122, a gate driver 124, and a data driver 126. The timing controller 122 may receive an image signal RGB and control signals CTRL from the external (e.g., external to the display apparatus). The control signals CTRL, for example, may include a vertical synchronization signal, a horizontal synchronization signal, a main clock signal, and a data enable signal. The timing controller 122 may provide an image data signal DATA (which is generated by processing the image signal RGB that is suitable for an operating condition of the display panel 110) and a first control signal CTRL1 to the data driver 126, based on the control signals CTRL. The timing controller 122 may provide a second control signal CTRL2 to the gate driver 124. The first control signal CTRL1 may include a horizontal synchronization start signal, a clock signal, and line latch signal, while the second control signal CTRL2 may include a vertical synchronization start signal, an output enable signal, and a gate pulse signal. The timing controller 122 may output the image data signal DATA, which may be variously modified according to an arrangement of the pixels PX of the display panel 110 and a display frequency. The timing controller 122 may provide a backlight control signal BLC to control the backlight unit 130.

The gate driver 124 may drive the gate lines GL1~GLn in response to the second control signal CTRL2, which is provided from the timing controller 122. The gate driver 124 may include a gate drive Integrated Circuit (IC). The gate driver 124 may be implemented in a circuit including oxide semiconductor, amorphous semiconductor, crystalline semiconductor, and/or polycrystalline semiconductor.

The data driver 130 may drive the data lines DL1~DLm in response to the image data signal DATA and the first control signal CTRL1, which are provided from the timing controller 122.

The backlight unit 130 may be arranged opposite to the pixels under the display panel 110. The backlight unit 130 may operate in response to the backlight control signal BLC, which is provided from the timing controller 122. Detailed configuration and operation of the backlight unit 130 will be described in conjunction with FIG. 2.

Figure 2:
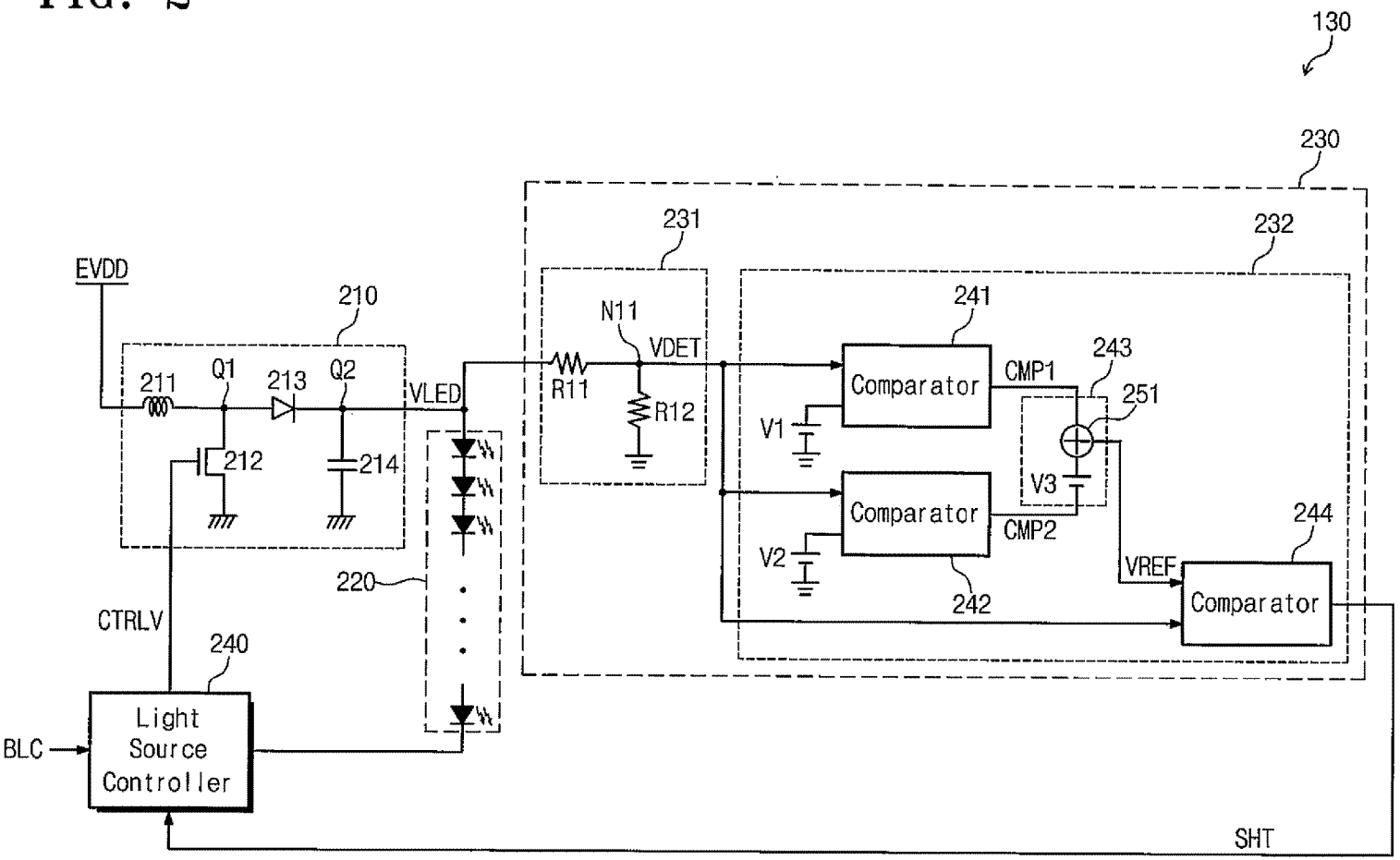
FIG. 2 is a diagram illustrating a configuration of the backlight unit shown in FIG. 1 according to an embodiment of the inventive concept.

FIG. 2 is a diagram illustrating a configuration of the backlight unit shown in FIG. 1 according to an embodiment of the inventive concept.

Referring to FIG. 2, the backlight unit 130 may include a power converter 210, a light source 220, a short-circuit detector 230, and a light source controller 240. The light source 220 may include an LED string including a plurality of LEDs. An end of the light source 220 may be connected to a light-source power voltage VLED, which may be supplied from the power converter 210. The other end of the light source 220 may be connected to the light source controller 240.

While FIG. 2 shows the light source 220 as including one LED string, the present inventive concept is not limited thereto, and in some embodiments the light source 220 may include two or more LED strings. Each of the plurality of LEDs may include a white LED to radiate white light, a red LED to radiate blue light, a blue LED to radiate blue light, and a green LED to radiate green light. The white LED, the red LED, the blue LED, and the green LED may each have different characteristics, for example, in forward drive voltage Vf that is to be applied for light emission. For uniformity of luminance, it may be desirable to reduce gaps of the forward drive voltage Vf between the LEDs. FIG. 2 is illustrated with the light source 220 including an LED string formed of a plurality of LEDs, but the present inventive concept is not limited thereto, and the LEDs may, for example, be replaced with laser diodes and/or carbon nanotubes.

The power converter 210 may convert a power voltage EVDD, which is input from the external, into the light-source power voltage VLED. A voltage level of the light-source power voltage VLED may be set at a voltage level sufficient to drive the LEDs of the light source 220.

The power converter 210 may include an inductor 211, a transistor 212, a diode 213, and a capacitor 214. The inductor 211 may be connected between the power voltage EVDD and a node Q1. A gate electrode of the transistor 212 may be connected to a voltage control signal CTRLV that is supplied from the light source controller 240. The diode 213 may be connected between the node Q1 and a node Q2. In this embodiment, the diode 213 may be formed of, for example, a Schottky diode, but the present inventive concept is not limited thereto. The capacitor 214 may be connected between the node Q2 and a ground voltage. The light-source power voltage VLED at the node Q2 may be supplied to the end of the light source 220.

With the above-described structure, the power converter 210 may convert the power voltage EVDD, which is supplied from the external, into the light-source power voltage VLED, and may output the light-source power voltage VLED. For example, the transistor 212 may be turned on/off in response to the voltage control signal CTRLV to control generation of the light-source power voltage VLED and luminance of the light source 220.

The short-circuit detector 230 may receive the light-source power voltage VLED from the power converter 210, and may output a short-circuit signal SHT. The short-circuit detector 230 may include a voltage divider 231 and a comparing circuit 232. The voltage divider 231 may divide the light-source power voltage VLED, and may output a detection voltage VDET. The comparing circuit 232 may generate a reference voltage VREF corresponding to a voltage level of the detection voltage VDET, and may compare the reference voltage VREF with the detection voltage VDET to enable the short-circuit signal SHT in accordance with a result of the comparison.

The voltage divider 231 may include resistors R11 and R12. The resistor R11 may be connected between the light-source power voltage VLED and a node N11. The resistor R12 may be connected between the node N11 and the ground voltage. A voltage of the node N11 may be the detection voltage VDET.

The comparing circuit 232 may include first to third comparators 241, 242, and 244, and an adding circuit 243. The first comparator 241 may compare voltage levels of the detection voltage VDET with a first voltage V1, and may output a first comparison signal CMP1. When the voltage level of the detection voltage VDET is higher than that of the first voltage V1, the first comparator 241 may output the first comparison signal CMP1 having a set or predetermined level (e.g., a first or second level of, for example, 1V). When the voltage level of the detection voltage VDET is lower than that of the first voltage V1, the first comparator 241 may output the first comparison signal CMP1 having another set or predetermined level (e.g., a first or second level of, for example, 0V).

The second comparator 242 may compare the voltage level of the detection voltage VDET with that of a second voltage V2, and may output a second comparison signal CMP2. When the voltage level of the detection voltage VDET is higher than that of the second voltage V2, the second comparator 242 may output a second comparison signal CMP2 having a voltage level of, for example, 1V. When the voltage level of the detection voltage VDET is lower than that of the second voltage V2, the second comparator 242 may output the second comparison signal CMP2 having a voltage level of, for example, 0V. In this embodiment, the voltage level of the second voltage V2 may be higher than that of the first voltage V1.

The adding circuit 243 may output a reference voltage VREF corresponding to the first comparison signal CMP1, which is provided from the first comparator 241, and the second comparison signal CMP2, which is provided from the second comparator 242. The adding circuit 243 may include an adder 251. The adder 251 may output the reference voltage VREF by adding the first comparison signal CMP1, the second comparison signal CMP2, and a third voltage V3 supplied thereto. The third voltage V3 may have a set or predetermined voltage level (e.g., 2.5V).

The third comparator 244 may compare a voltage level of the reference voltage VREF with that of the detection voltage VDET, and may enable the short-circuit signal SHT in accordance with a result of the comparison.

The light source controller 240 may generate the voltage control signal CTRLV in response to the backlight control signal BLC, which may be provided from the timing controller 122 (see FIG. 1). Additionally, the light source controller 240 may generate the voltage control signal CTRLV in response to the short-circuit signal SHT, which may be provided from the short-circuit detector 230.

Figure 3:
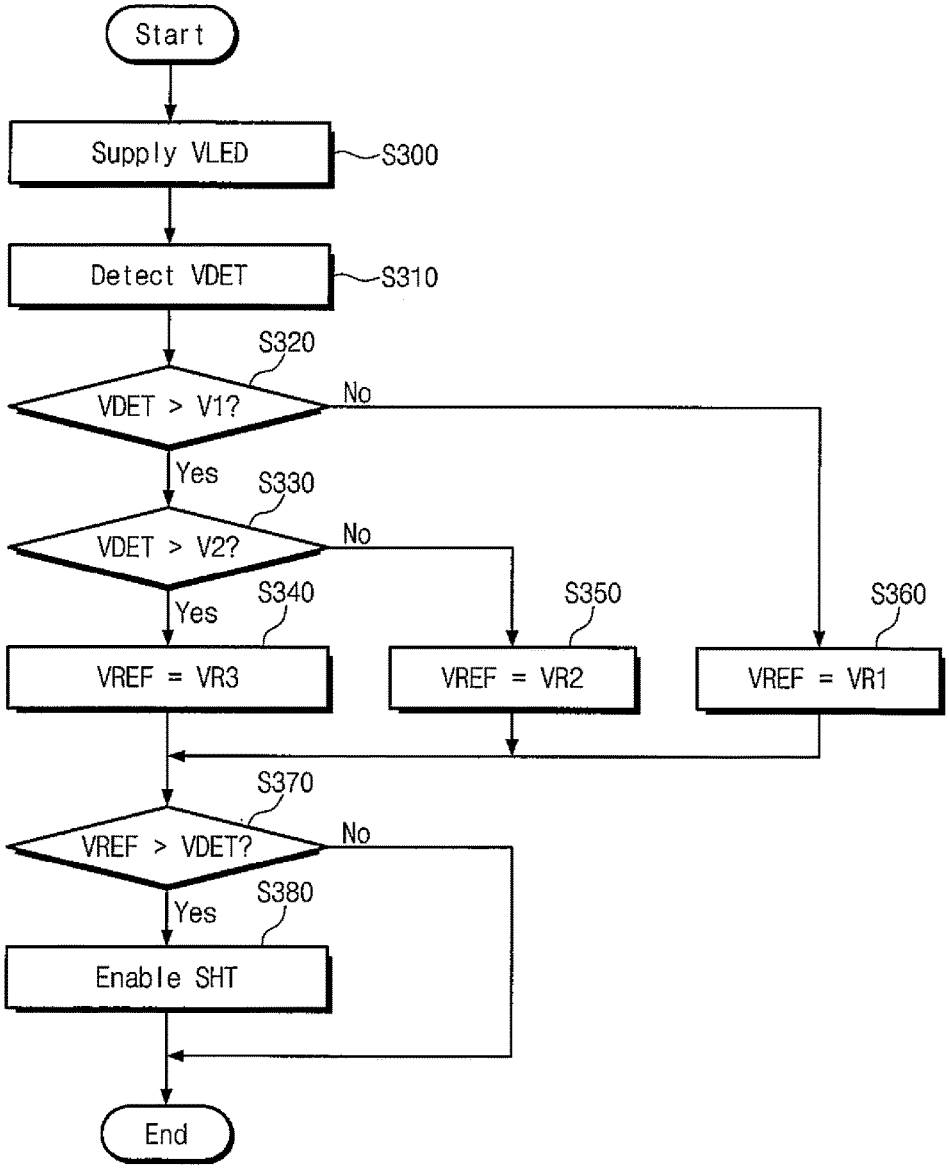
FIG. 3 is a flowchart showing an operation of the backlight unit shown in FIG. 2 according to an embodiment of the inventive concept.
Figure 4:
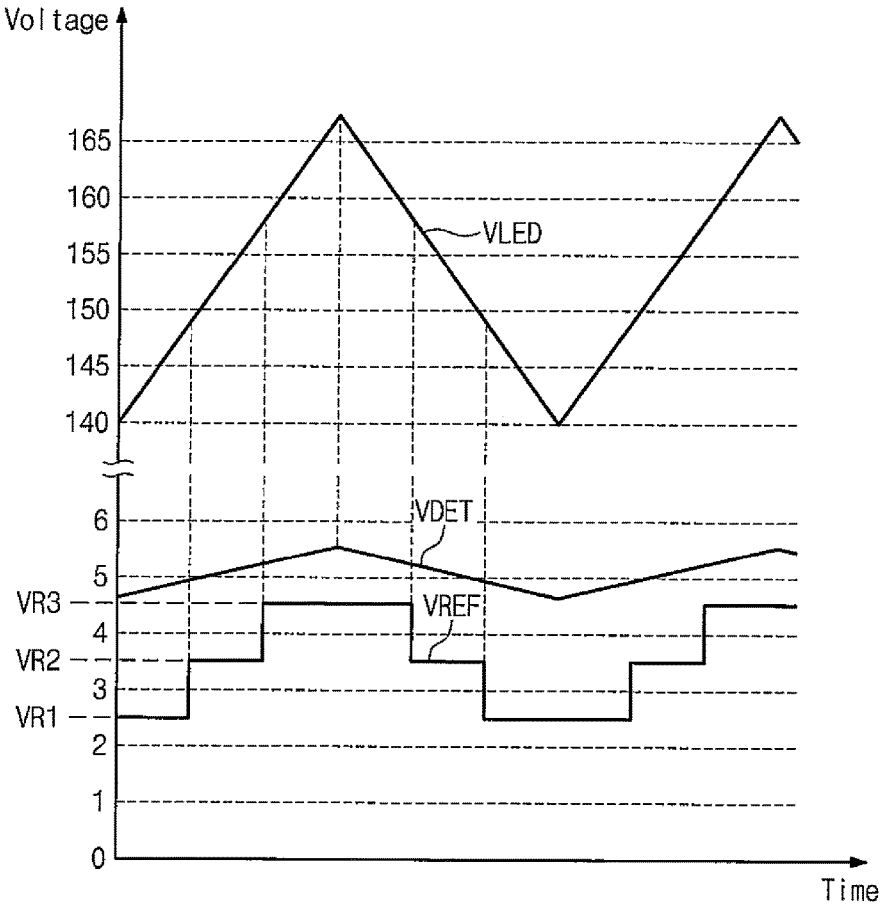
FIG. 4 is a graph illustrating voltage levels of a light-source power voltage, a detection voltage, and a reference voltage, which are generated from the backlight unit shown in FIG. 2, according to an embodiment of the inventive concept.

FIG. 3 is a flowchart showing an operation of the backlight unit shown in FIG. 2 according to an embodiment of the inventive concept. FIG. 4 is a graph illustrating voltage levels of a light-source power voltage, a detection voltage, and a reference voltage, which are generated from the backlight unit shown in FIG. 2, according to an embodiment of the inventive concept.

Referring to FIGS. 2 to 4, the power converter 210 may supply the light-source power voltage VLED (act S300). The light-source power voltage VLED may be set at a voltage level sufficient to drive the LEDs of the light source 220. For example, the light-source power voltage VLED may be variably set in the range of 140V~167V. Further, it may be desirable to set the voltage level of the light-source power voltage VLED in consideration of the forward drive voltages Vf respective to the LEDs of the light source 220.

The voltage divider 231 may divide the light-source power voltage VLED to output the detection voltage VDET (act S310). For example, when a variable range of the light-source power voltage VLED is 140V~167V, it may be desirable for resistance values of the resistors R11~R12 to be set so that the detection voltage VDET is within the range of 4.8V~5.6V.

The first comparator 241 may compare the detection voltage VDET with the first voltage V1 (act S320). The second comparator 242 may compare the detection voltage VDET with the second voltage V2 (act S330). The voltage level of the second voltage V2 may be higher than that of the first voltage V1. For example, the first voltage V1 may be set at 4.94V and the second voltage V2 may be set at 5.24V.

When the voltage level of the detection voltage VDET is lower than that of the first voltage V1, the first comparator 241 may output the first comparison signal CMP1 having the voltage level of, for example, 0V. When the voltage level of the detection voltage VDET is lower than that of the second voltage V2, the second comparator may output the second comparison signal CMP2 having the voltage level of, for example, 0V. When both the first comparison signal CMP1 and the second comparison signal CMP2 have the voltage level of, for example, 0V, the adding circuit 243 may output a first reference voltage VR1 as the reference voltage VREF (act S360). As shown in FIG. 4, the first reference voltage VR1 may be 2.5V.

When the voltage level of the detection voltage VDET is higher than that of the first voltage V1 but lower than that of the second voltage V2, the first comparator 241 may output the first comparison signal CMP1 having the voltage level of, for example, 1V, and the second comparator 242 may output the second comparator signal CMP2 having the voltage level of, for example, 0V. When the first comparator signal CMP1 has the voltage level of, for example, 1V, and the second comparison signal CMP2 has the voltage level of, for example, 0V, the adding circuit 243 may output a second reference voltage VR2 as the reference voltage VREF (act 8350). The second reference voltage VR2 may be 3.5V.

When the voltage level of the detection voltage VDET is higher than that of the first voltage V1, the first comparator 241 may output the first comparison signal CMP1 having the voltage level of 1V. When the voltage level of the detection voltage VDET is higher than that of the second voltage V2, the second comparator 242 may output the second comparison signal CMP2 having the voltage level of 1V. When the first comparison signal CMP1 and the second comparison signal CMP2 have the voltage level of, for example, 1V, the adding circuit 243 may output a third reference voltage VR3 as the reference voltage VREF (act S340). The third reference voltage VR3 may be 4.5V.

The third comparator 244 may compare the voltage level of the detection voltage VDET with that of the reference voltage VREF (act S370). When the voltage level of the reference voltage VREF is higher than that of the detection voltage VDET, the third comparator 244 may determine that there is at least one short-circuited one of the LEDs of the light source 220, and may thereby enable the short-circuit signal SHT to be activated (act S380).

As shown in FIG. 4, for example, when the light-source power voltage VLED is generated with 145V from the power converter 210, the detection voltage VDET may be about 4.7V. During this, the reference voltage VREF may be set at the first reference voltage VR1 (e.g., 2.5V). When the detection voltage VDET becomes lower than 2.5V while the backlight unit 130 is operating, the short-circuit signal SHT may be enabled thereby. The light source controller 240 may output the voltage control signal CTRLV having a low level (e.g., 0V) to interrupt generation of the light-source power voltage VLED in response to the enabled short-circuit signal SHT.

When the light-source power voltage VLED is 165V, the detection VDET may be about 5.5V. During this, the reference voltage VREF may be set at the third reference voltage VR3 (e.g., 4.5V). When the detection voltage VDET becomes lower than 4.5V while the backlight unit 130 is operating, the short-circuit signal SHT may be enabled thereby. The light source controller 240 may output the voltage control signal CTRLV having the low level (0V) to interrupt generation of the light-source power voltage VLED in response to the enabled short-circuit signal SHT.

When the light-source power voltage VLED is set in the range of about 140V at minimum to about 167V at maximum, a gap between the minimum set voltage and the maximum set voltage may be about 27V. This 27V may correspond to a voltage variation when nine or more LEDs of the light source 220 are conditioned in a short circuit (e.g., in a short circuit state). When the reference voltage VREF is set at a fixed level, it may result in a detection failure of a short circuit from the LEDs of the light source 220 in accordance with a set level of the light-source power voltage VLED.

As a voltage level of the reference voltage VREF, according to some embodiments of the inventive concept, may be variously set at, for example, 2.5V, 3.5V, and 4.5V, a short circuit may be correctly detected from the LEDs of the light source 220. While a voltage level of the reference voltage VREF may be variously set at 2.5V, 3.5V, and 4.5V, the present inventive concept is not limited thereto, and the voltage level of the reference voltage VREF may be modified in accordance with a voltage level of the third voltage V3. Additionally, when additional comparators are further included therein in addition to the first comparator 241 and the second comparator 242, a number of modifiable voltage levels of the reference voltage VREF may be increased.

Figure 5:
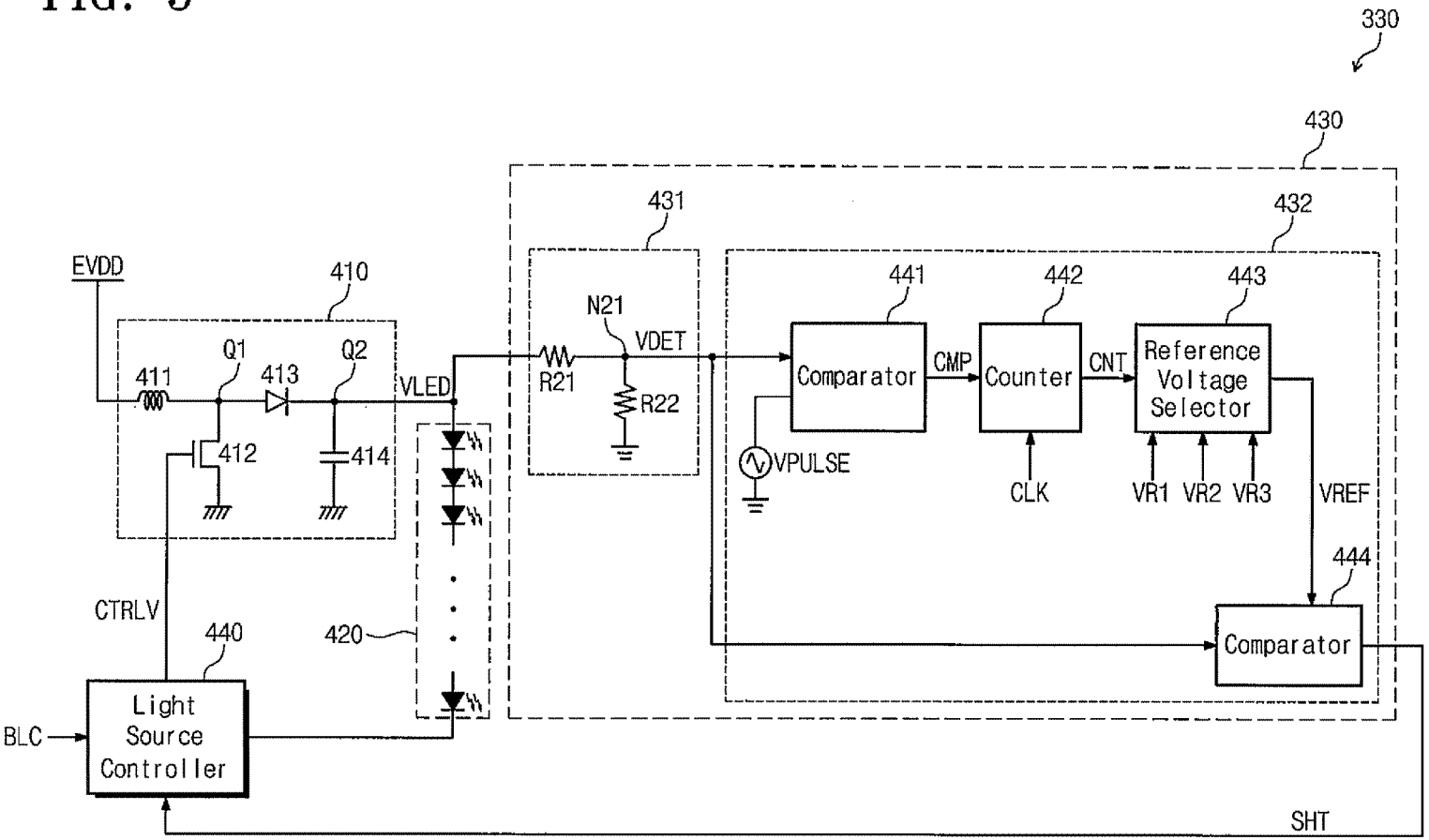
FIG. 5 is a diagram illustrating a configuration of the backlight unit shown in FIG. 1 according to another embodiment of the inventive concept.

FIG. 5 is a diagram illustrating a configuration of the backlight unit shown in FIG. 1 according to another embodiment of the inventive concept.

Referring to FIG. 5, the backlight unit 330 may include a power converter 410, a light source 420, a short-circuit detector 430, and a light source controller 440. The light source 420 may include an LED string including a plurality of LEDs connected in series. An end of the light source 220 may be connected to a light-source power voltage VLED, which is supplied from the power converter 410. The other end of the light source 220 may be connected to the light source controller 440. FIG. 5 illustrates the light source 420 as including one LED string, but the present inventive concept is not limited thereto, and in some embodiments, the light source 420 may include two or more LED strings.

The power converter 410 may convert a power voltage EVDD, which is input from the external, into the light-source power voltage VLED. The light-source power voltage VLED may be set on a voltage level sufficient to drive the LEDs of the light source 420.

The power converter 410 may include an inductor 411, a transistor 412, a diode 413, and a capacitor 414. The inductor 411 may be connected between the power voltage EVDD and a node Q1. The transistor 412 may be connected between the node Q1 and a ground voltage. A gate node of the transistor 412 may be connected to a voltage control signal CTRLV, which is provided from the light source controller 440. The diode 413 may be connected between the node Q1 and a node Q2. In some embodiments, the diode 413 may be formed of a Schottky diode, but the present inventive concept is not limited thereto. The capacitor 414 may be connected between the node Q2 and a ground voltage. The light-source power voltage VLED at the node Q2 may be supplied to the end of the light source 420.

With the above-described configuration, the power converter 410 may convert the power voltage EVDD, which is supplied from the external, into the light-source power voltage VLED, and may output the light-source power voltage VLED. For example, in response to the voltage control signal CTRLV, the transistor 412 may be turned on/off to control the light-source power voltage VLED to be generated therefrom, and to adjust luminance of the light source 420.

The short-circuit detector 430 may receive the light-source power voltage VLED from the power converter 410, and may output a short-circuit signal SHT. The short-circuit detector 430 may include a voltage divider 431 and a comparing circuit 432. The voltage divider 431 may divide the light-source power voltage VLED to output a detection voltage VDET. The comparing circuit 432 may generate a reference voltage VREF corresponding to the detection voltage VDET, compare the reference voltage VREF with the detection voltage VDET, and enable the short-circuit signal SHT according to a result of the comparison.

The voltage divider 431 may include resistors R21 and R22. The resistor R21 may be connected between the light-source power voltage VLED and a node N21. The resistor R22 may be connected between the node N21 and the ground voltage. A voltage at the node N21 may correspond to the detection voltage VDET.

The comparing circuit 432 may include a first comparator 441, a counter 442, a reference voltage selector 443, and a second comparator 444. The first comparator 441 may compare the detection voltage VDET with a pulse voltage VPULSE to output a comparison signal CMP. When a voltage level of the detection voltage VDET is higher than that of the pulse voltage VPULSE, the first comparator 441 may output the comparison signal CMP having a set or predetermined voltage level (e.g., a first or second level being 1V). When the voltage level of the detection voltage VDET is lower than that of the pulse voltage VPULSE, the first comparator 441 may output the comparison signal CMP having another set or predetermined voltage level (e.g., a first or second level being 0V). The pulse voltage VPULSE may be a voltage having a period (e.g., a predetermined period) having a triangular, sawtooth, or sinusoidal wave.

The counter 442 may receive the comparison signal CMP, perform a count-up operation in synchronization with a clock signal CLK, and may output a count signal CNT. For example, the counter 442 may perform the count-up operation in synchronization with the clock signal CLK when the comparison signal CMP has the voltage level of, for example, 0V, and may output the count signal CNT when the comparison signal CMP has the voltage level of for example, 1V. The counter 442 may output the count signal CNT in correspondence with the voltage level of the detection voltage VDET.

The reference voltage selector 443 may output one of first to third reference voltages VR1, VR2, and VR3 in correspondence with the count signal CNT. The first to third reference voltages VR1, VR2, and VR3 may have different voltage levels from each other, e.g., VR1<VR2<VR3.

The second comparator 444 may compare a voltage level of the reference voltage VREF with that of the detection voltage VDET to enable the short-circuit signal SHT according to a result of the comparison.

The light source controller 440 may generate the voltage control signal CTRLV in response to a backlight control signal BLC, which is provided from a timing controller 122 (see FIG. 1). Additionally, the light source controller 440 may generate the voltage control signal CTRLV in response to the short-circuit signal SHT, which is provided from the short-circuit detector 430.

Figure 6:
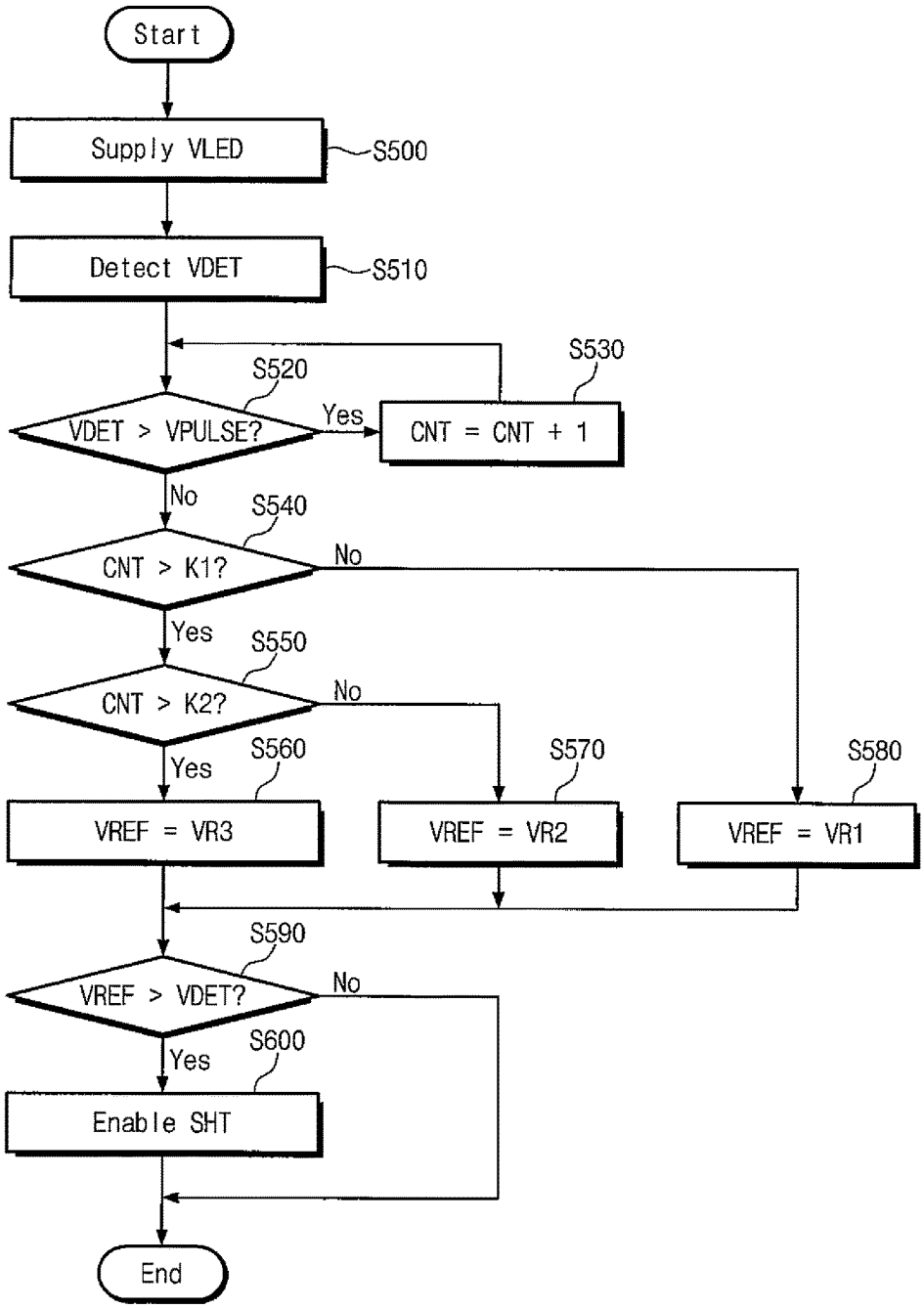
FIG. 6 is a flowchart showing an operation of the backlight unit shown in FIG. 5 according to another embodiment of the inventive concept.

FIG. 6 is a flowchart showing an operation of the backlight unit shown in FIG. 5 according to another embodiment of the inventive concept.

Referring to FIGS. 5 and 6, the power converter 410 may supply the light-source power voltage VLED (act S500). The light-source power voltage VLED may be set at a voltage level sufficient to drive the LEDs of the light source 420. For example, the light-source power voltage VLED may be set in the range of 140V~167V. In some embodiments, it may be desirable to set a voltage level of the light-source power voltage VLED in consideration of each forward drive voltage Vf of the LEDs of the light source 420.

The voltage divider 431 may divide the light-source power voltage VLED to output the detection voltage VDET (act S510). For example, when a variable range of the light-source power voltage VLED is 140V~167V, it may be desirable to set resistance values of the resistors R21 and R22 so that a variable range of the detection voltage VDET may be 4.8V~5.6V.

The first comparator 441 may compare the detection voltage VDET with the pulse voltage VPULSE (act S520). When the voltage level of the detection voltage VDET is lower than that of the pulse voltage VPULSE, the first comparator 441 may output the comparison signal CMP having the voltage level of, for example, 0V. When the comparison signal CMP has the voltage level of, for example, 0V, the counter 442 may perform a count-up operation in response to the clock signal CLK (act S530). When the comparison signal CMP has the voltage level of, for example, 1V, the counter 442 may output the count signal CNT to the reference voltage selector 443.

The reference voltage selector 443 may compare the count signal CNT with a first value K1 (act S540). When a level of the count signal CNT is lower than the first value K1, the reference voltage selector 443 may output the first reference voltage VR1 as the reference voltage VREF (act S580). The reference voltage selector 443 may compare the count signal CNT with a second value K2 (act S550). When the level of the count signal CNT is higher than the first value K1 but lower than the second value K2, the reference voltage selector 443 may output the second reference voltage VR2 as the reference voltage VREF (act S570). When the level of the count signal CNT is higher than the second value K2, the reference voltage selector 443 may output the third reference voltage VR3 as the reference voltage VREF (act S560). For example, the first reference voltage VR1 may be 2.5V, the second reference voltage VR2 may be 3.5V, and the third reference voltage VR3 may be 4.5V. In some embodiment, the level of the second value K2 may be higher than that of the first value K1.

The second comparator 444 may compare the voltage level of the detection voltage VDET with that of the reference voltage VREF (act S590). When the voltage level of the reference voltage VREF is higher than that of the detection voltage VDET, the second comparator 444 may determine that there is a short-circuit of at least one of the LEDs of the light source 420, and may enable the short-circuit signal SHT to be activated (act S600).

According to one or more embodiments of the inventive concept, since a voltage level of the reference voltage VREF can be variously set on one of, for example, 2.5V, 3.5V, and 4.5V in accordance with a voltage level of the light-source power voltage VLED, it may be possible to correctly detect whether or not there is a short circuit from the LEDs of the light source 420. FIG. 5 is illustrated as having a voltage level of the reference voltage VREF as variously set on one of 2.5V, 3.5V, and 4.5V, but the present inventive concept is not limited thereto, and the voltage levels and the number of the reference voltages VREF may be modified by varying the voltage levels and the numbers of the first to third reference voltages VR1~VR3.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the inventive concept.

Unless otherwise defined, all terms (including technical and scientific terms) used herein have the same meaning as commonly understood by one of ordinary skill in the art to which the inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

While the inventive concept has been described with reference to the example embodiments, those skilled in the art will recognize that various changes and modifications to the described embodiments may be performed, all without departing from the spirit and scope of the inventive concept. Furthermore, those skilled in the various arts will recognize that the inventive concept described herein will suggest solutions to other tasks and adaptations for other applications. It is the applicant's intention to cover by the claims herein, all such uses of the inventive concept, and those changes and modifications which could be made to the example embodiments of the inventive concept herein chosen for the purpose of disclosure, all without departing from the spirit and scope of the inventive concept. Thus, the example embodiments of the inventive concept should be considered in all respects as illustrative and not restrictive, with the spirit and scope of the inventive concept being indicated by the appended claims and their equivalents.

What is claimed is:

1. A backlight unit comprising:

a power converter configured to generate a light-source power voltage according to a voltage control signal;

an LED string connected to the light-source power voltage;

a short-circuit detector configured to receive the light-source power voltage and to enable a short-circuit signal; and a light source controller configured to generate the voltage control signal to interrupt generation of the light-source power voltage when the short-circuit signal is enabled, wherein the short-circuit detector comprises:

a voltage divider configured to divide the light-source power voltage to output a detection voltage; and a comparing circuit configured to generate a reference voltage having a reference voltage level corresponding to a voltage level of the detection voltage among a plurality of reference voltage levels, and to enable the short-circuit signal in accordance with a result of a comparison of the reference voltage level with the detection voltage, and wherein the comparing circuit comprises:

a first comparator configured to compare the voltage level of the detection voltage with that of a first voltage, and to output a first comparison signal;

a second comparator configured to compare the voltage level of the detection voltage with that of a second voltage different than the first voltage, and to output a second comparison signal;

an adding circuit configured to output the reference voltage corresponding to the first comparison signal and the second comparison signal; and a third comparator configured to compare a voltage level of the reference voltage with that of the detection voltage, and to enable the short-circuit signal in accordance with the result of the comparison.

2. The backlight unit of claim 1, wherein the adding circuit is configured to add the first comparison signal, the second comparison signal, and a bias voltage to output the reference voltage.

3. The backlight unit of claim 2, wherein a voltage level of the second voltage is higher than that of the first voltage.

4. The backlight unit of claim 1, wherein the comparing circuit is configured to:

output the reference voltage with a first reference voltage level when the detection voltage is lower than a first voltage level;

output the reference voltage with a second reference voltage level when the detection voltage is higher than the first voltage level and lower than a second voltage level; and output the reference voltage with a third reference voltage level when the detection voltage is higher than the second voltage level, and wherein the second voltage level is higher than the first voltage level.

5. The backlight unit of claim 1, wherein one end of the LED string is connected to the light-source power voltage and another end of the LED string is connected to the light source controller.

6. The backlight unit of claim 1, wherein the voltage divider comprises:

a first resistor connected between the light-source power voltage and a first node; and a second resistor connected between the first node and a ground voltage, and wherein the voltage divider is configured to output a voltage at the first node as the detection voltage.

7. A display apparatus comprising: a display panel comprising a plurality of pixels;

a drive circuit configured to control the display panel to display an image; and a backlight configured to supply light to the display panel, wherein the backlight comprises:

a power converter configured to generate a light-source power voltage according to a voltage control signal; an LED string connected to the light-source power voltage;

a short-circuit detector configured to receive the light-source power voltage and to enable a short-circuit signal; and a light source controller configured to generate the voltage control signal to interrupt generation of the light-source power voltage when the short-circuit signal is enabled, and wherein the short-circuit detector comprises:

a voltage divider configured to divide the light-source power voltage to output a detection voltage; and a comparing circuit configured to generate a reference voltage having a reference voltage level corresponding to a voltage level of the detection voltage among a plurality of reference voltage levels the detection voltage among a plurality of reference voltage levels, and to enable the short-circuit signal in accordance with a result of a comparison of the reference voltage level with the detection voltage, and wherein the comparing circuit comprises:

a first comparator configured to compare the voltage level of the detection voltage with that of a first voltage to output a first comparison signal;

a second comparator configured to compare the voltage level of the detection voltage with that of a second voltage different than the first voltage to output a second comparison signal;

an adding circuit configured to output the reference voltage corresponding to the first comparison signal and the second comparison signal; and a third comparator configured to compare a voltage level of the reference voltage with that of the detection voltage, and to enable the short-circuit signal in accordance with the result of the comparison.

8. The display apparatus of claim 7, wherein the adding circuit is configured to add the first comparison signal, the second comparison signal, and a bias voltage to output the reference voltage.

9. The display apparatus of claim 8, wherein a voltage level of the second voltage is higher than that of the first voltage.

10. An operation method of a backlight unit, the method comprising:

providing a light-source power voltage;

detecting a voltage level of the light-source power voltage;

selecting a reference voltage level for a reference voltage from a plurality of reference voltage levels in accordance with a voltage level of a detection voltage;

outputting the reference voltage having the selected reference voltage level;

comparing the reference voltage with the detection voltage and enabling a short-circuit signal in accordance with a result of the comparison; and interrupting generation of the light-source power voltage when the short-circuit signal is enabled, wherein selecting the reference voltage level comprises comparing the voltage level of the detection voltage with that of a first voltage to output a first comparison signal, and comparing the voltage level of the detection voltage with that of a second voltage different than the first voltage to output a second comparison signal; and wherein outputting the reference voltage having the selected reference voltage level comprises outputting the reference voltage corresponding to the first comparison signal and the second comparison signal.

11. The operation method of claim 10, wherein the outputting of the reference voltage comprises:

outputting the reference voltage with a first level when the detection voltage is lower than a first voltage level;

outputting the reference voltage with a second level when the detection voltage is higher than the first voltage level and lower than a second voltage level; and outputting the reference voltage with a third level when the detection voltage is higher than the second voltage level, and wherein the second voltage level is higher than the first voltage level.

* * * * *